US007438623B2

(12) United States Patent
Lin

(10) Patent No.: US 7,438,623 B2
(45) Date of Patent: Oct. 21, 2008

(54) GEOMETRIC CONSTRUCTION SYSTEM

(76) Inventor: Wen-Pin Lin, No. 30, Chien-Yung St., Tung Dist., Taichung City (TW)

( * ) Notice: Subject to any disclaimer, the term of this patent is extended or adjusted under 35 U.S.C. 154(b) by 542 days.

(21) Appl. No.: 11/221,154

(22) Filed: Sep. 6, 2005

(65) Prior Publication Data

US 2007/0051055 A1 Mar. 8, 2007

(51) Int. Cl.
*A63H 33/08* (2006.01)

(52) U.S. Cl. ..... 446/108; 446/115; 446/116; 446/104; 52/81.1; 52/80.2

(58) Field of Classification Search ..... 52/80.2, 52/81.1, 591.1, 592.1, 284, DIG. 10; 446/108, 446/109, 111, 112, 113, 122, 121, 120, 115, 446/124, 125; 403/364, 339, 340
See application file for complete search history.

(56) References Cited

U.S. PATENT DOCUMENTS 4,055,019 A 10/1977 Harvey
4,731,041 A * 3/1988 Ziegler ..... 446/115
4,792,319 A * 12/1988 Svagerko ..... 446/104
5,472,365 A * 12/1995 Engel ..... 446/104
5,501,626 A * 3/1996 Harvey ..... 446/104
D409,668 S * 5/1999 Madner ..... D21/484
6,142,848 A * 11/2000 Madner et al. ..... 446/115
6,186,855 B1 * 2/2001 Bauer et al. ..... 446/104
6,565,406 B2 * 5/2003 Huang ..... 446/104
2001/0010992 A1 * 8/2001 Brazier et al. ..... 446/108
2002/0098774 A1 * 7/2002 Huang ..... 446/487

* cited by examiner

*Primary Examiner*—Richard E. Chilcot
*Assistant Examiner*—Anthony N Bartosik
(74) *Attorney, Agent, or Firm*—Christie, Parker & Hale, LLP

(57) ABSTRACT

A geometric construction system includes: a plurality of flat panels; and a plurality of connecting units provided on side edges of the flat panels. Each connecting unit includes first and second engaging parts. The first engaging part is formed with a protrusion, and the second engaging part is formed with a recess such that the protrusion of the first engaging part on one of the flat panels is releasably engageable with the recess of the second engaging part on another of the flat panels. The second engaging part is further formed with resilient claws that project from a periphery of the recess. The claws of the second engaging part on one of the flat panels clamp resiliently the protusion of the first engaging part on another of the flat panels when the protrusion is moved into the recess of the second engaging part.

10 Claims, 12 Drawing Sheets

GEOMETRIC CONSTRUCTION SYSTEM

BACKGROUND OF THE INVENTION

1. Field of the Invention

The invention relates to a geometric construction system, more particularly to a geometric construction system having flat panels that can releasably engage each other through a connecting unit.

2. Description of the Related Art

FIG. 1 illustrates a conventional geometric-construction system disclosed in U.S. Pat. No. 4,055,019. The geometric construction system includes flat panels and connecting units 1 provided respectively on side edges of each of the flat panels for edgewise interengagement among the flat panels. Each of the connecting units 1 includes first and second engaging parts 13, 14 and first and second inserting spaces 11, 12 that are disposed at two opposite sides of the second engaging part 14. The first and second engaging parts 13, 14 are spaced apart from each other by the first inserting space 11. The first engaging part 13 is formed with a recess 151. The second engaging part 14 is formed with a protrusion 181. Upon edgewise interengagement between two of the flat panels, the second engaging part 14 on one of the two flat panels is received in the first inserting space 11, the protrusion 181 of the second engaging part 14 on said one of the two flat panels engages the recess 151 in the first engaging part 13 on the other of the flat panels, the first engaging part 13 on said one of the flat panels is received in the second inserting space 12, and the recess 151 in the first engaging part 13 on said one of the flat panels receives the protrusion 181 of the second engaging part 14 on the other of the flat panels. A first slit 141 is formed in the second engaging part 14. A second slit 143 is formed in each of the side edges of each of the flat panels, and cooperates with the first slit 141 to form the second engaging part 14 with a resilient end portion 142 that confines an end of the first inserting space 11 so as to facilitate insertion of the second engaging part 14 on said one of the flat panels into the first inserting space 11.

FIGS. 2 and 3 illustrate other conventional geometric construction systems that differ from the previous geometric construction system shown in FIG. 1 in the shapes and depths of the slits 141 (143).

The aforesaid conventional geometric construction systems suffer from a common drawback in that connection between two flat panels through engagement between the protrusion 181 and the recess 151 is relatively poor, which can cause the engaged flat panels to disconnect from each other during construction or playing with the flat panels. In addition, the shape and size of the resilient end portion 142 of the second engaging part 14 of the aforesaid conventional geometric construction systems, which is formed through formation of the slits 141 (143), are required to have a relatively high precision so as to provide the resilient end portion 142 with adequate flexibility for facilitating insertion of the second engaging part 14 into the first inserting space 11 and so as to provide suitable resilient forces for engagement between the protrusion 181 and the recess 151.

SUMMARY OF THE INVENTION

Therefore, the object of this invention is to provide a geometric construction system that can overcome at least one of the aforesaid drawbacks associated with the prior art.

According to this invention, there is provided a geometric construction system that comprises: a plurality of flat panels of polygonal shape, each of the flat panels having side edges; and a plurality of connecting units provided on the side edges, respectively, so as to permit edgewise interengagement between adjacent ones of the flat panels. At least one of the connecting units includes first and second engaging parts. The first engaging part is formed with a protrusion. The second engaging part is formed with a recess such that the protrusion of the first engaging part on one of the flat panels is releasably engageable with the recess of the second engaging part on another of the flat panels so as to permit edgewise interengagement between adjacent ones of the flat panels and rotation of the flat panels thus engaged relative to each other about an axis. The second engaging part is further formed with resilient claws that project from and that are angularly displaced around a periphery of the recess. Two adjacent ones of the claws of the second engaging part cooperatively define a gap therebetween. The claws of the second engaging part on one of the flat panels clamp resiliently the protrusion of the first engaging part on another of the flat panels when the protrusion is moved through the gap and into the recess of the second engaging part on said one of the flat panels.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
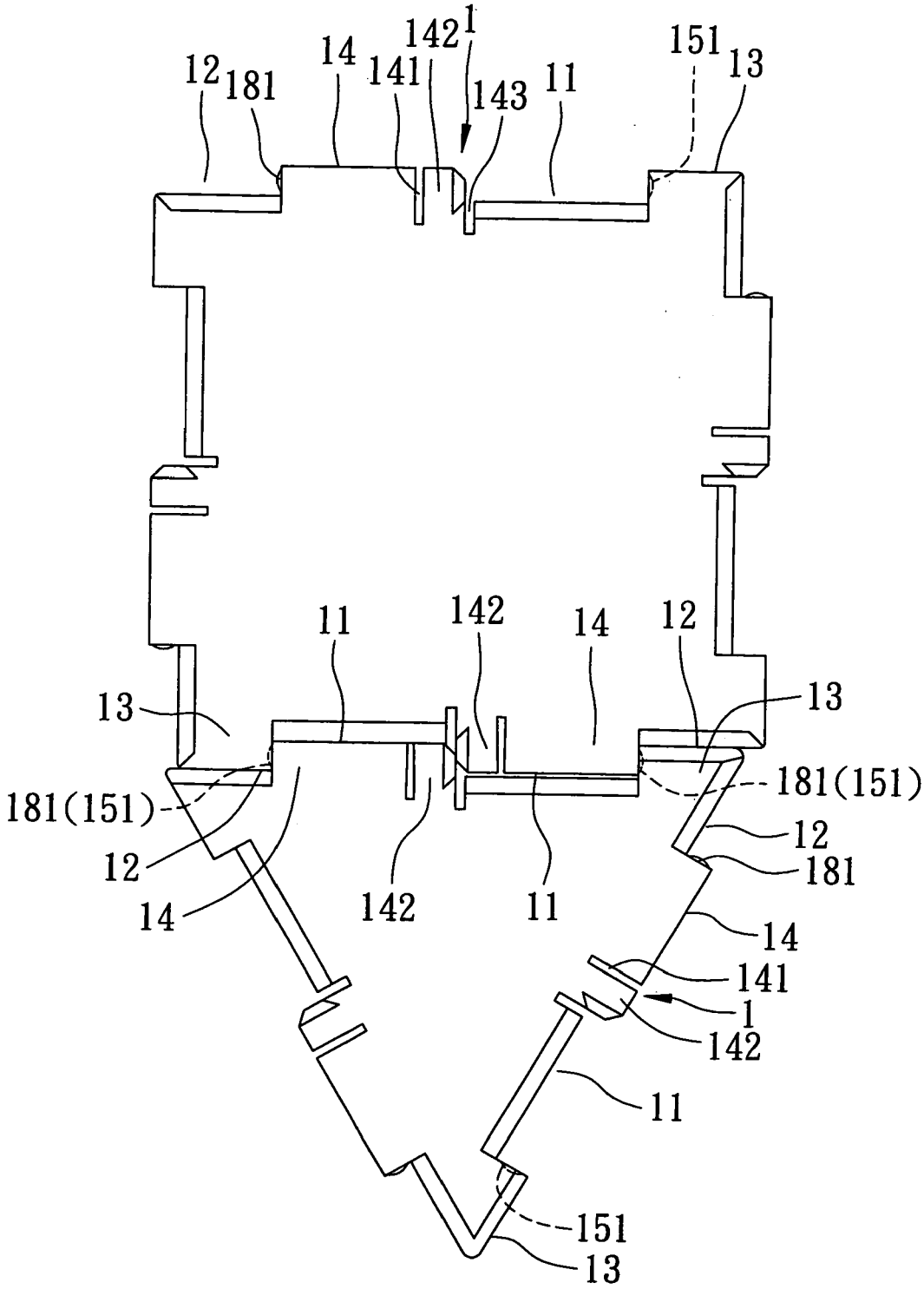
FIG. 1 PRIOR ART
FIG. 1 is a schematic view of a conventional geometric construction system.
Figure 2:
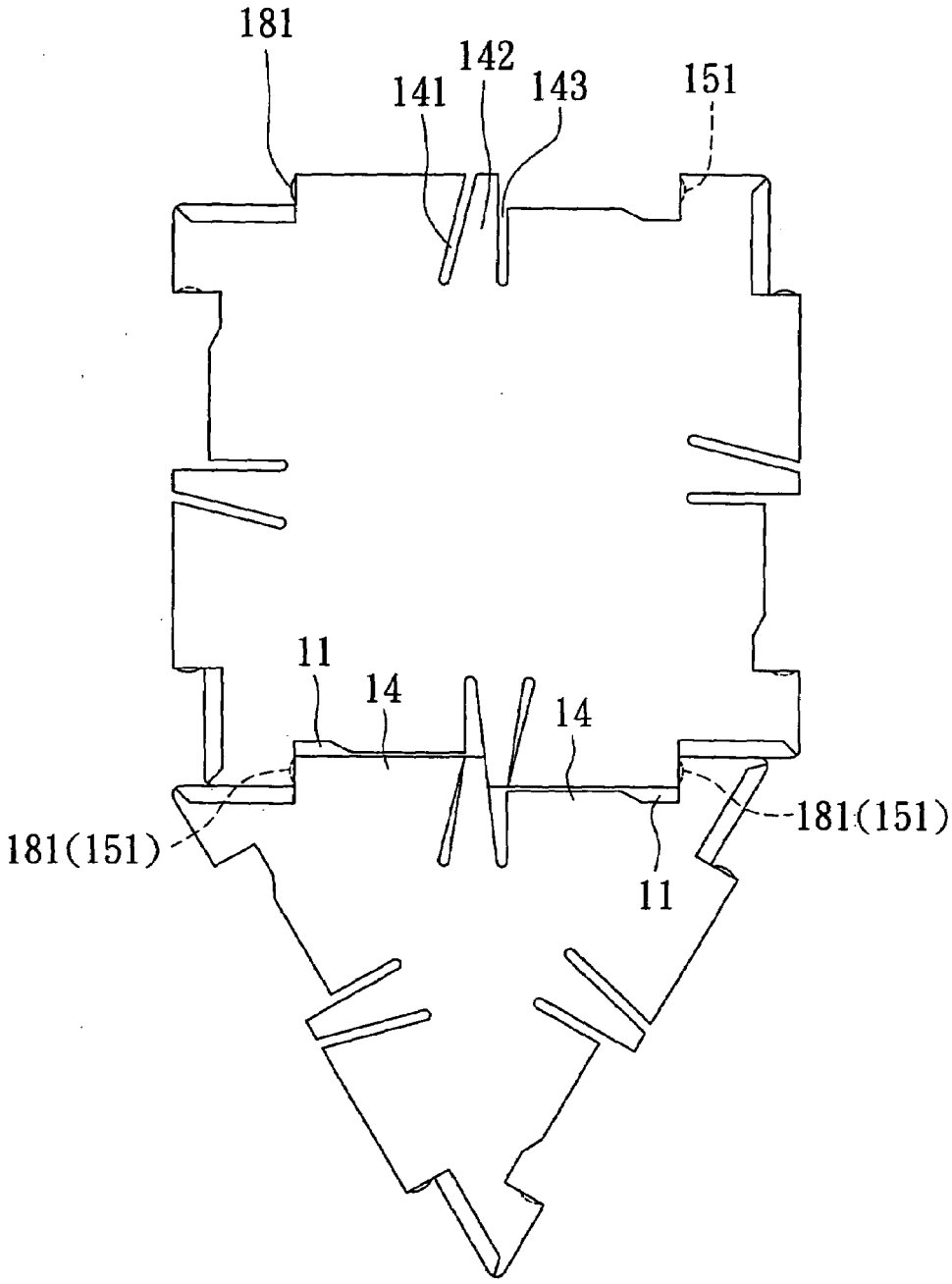
FIG. 2 PRIOR ART
FIG. 2 is a schematic view of another conventional geometric construction system.
Figure 3:
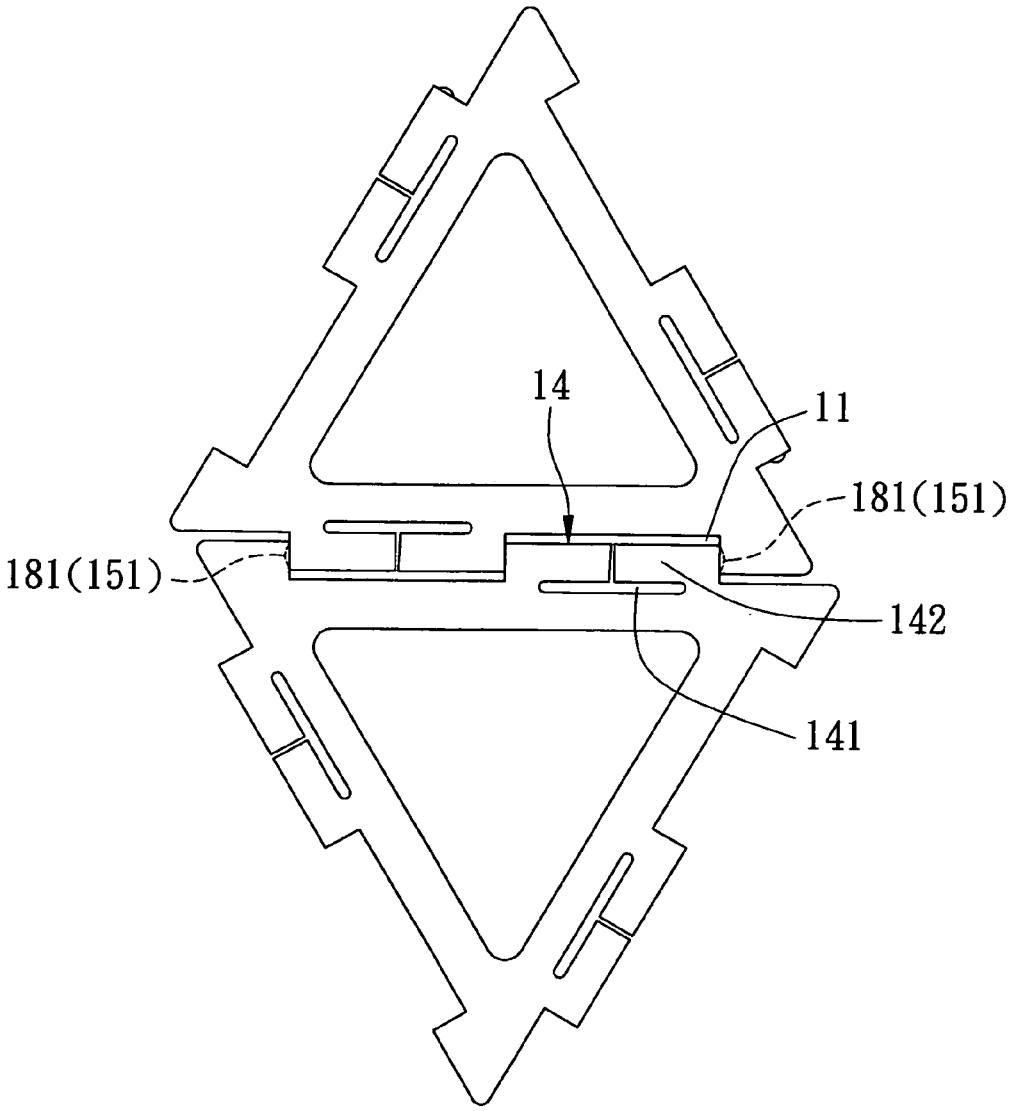
FIG. 3 PRIOR ART
FIG. 3 is a schematic view of yet another conventional geometric construction system.

Before the present invention is described in greater detail, it should be noted that same reference numerals have been used to denote like elements throughout the specification.

Figure 4:
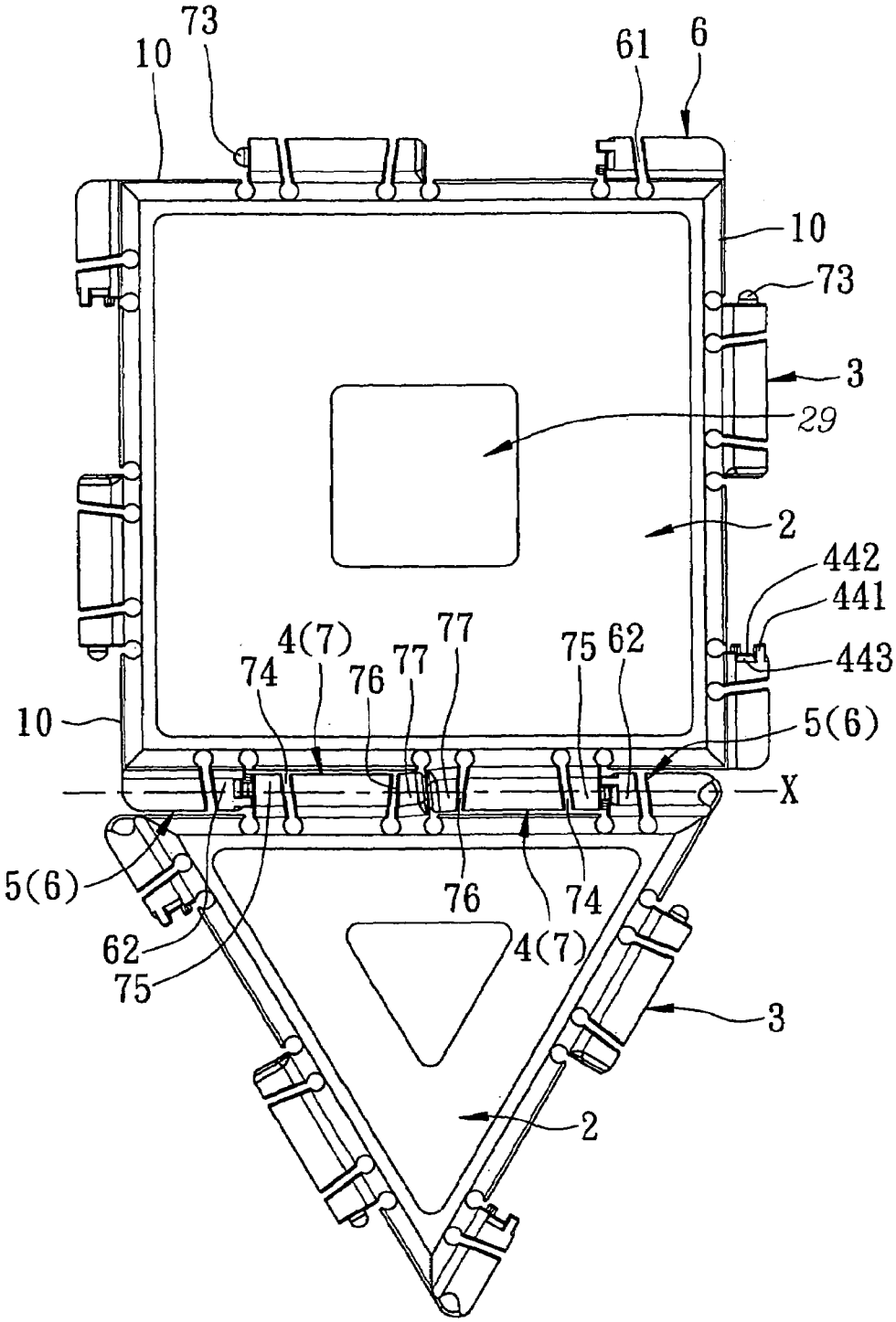
FIG. 4 is a schematic view of the first preferred embodiment of a geometric construction system according to the present invention.
Figure 5:
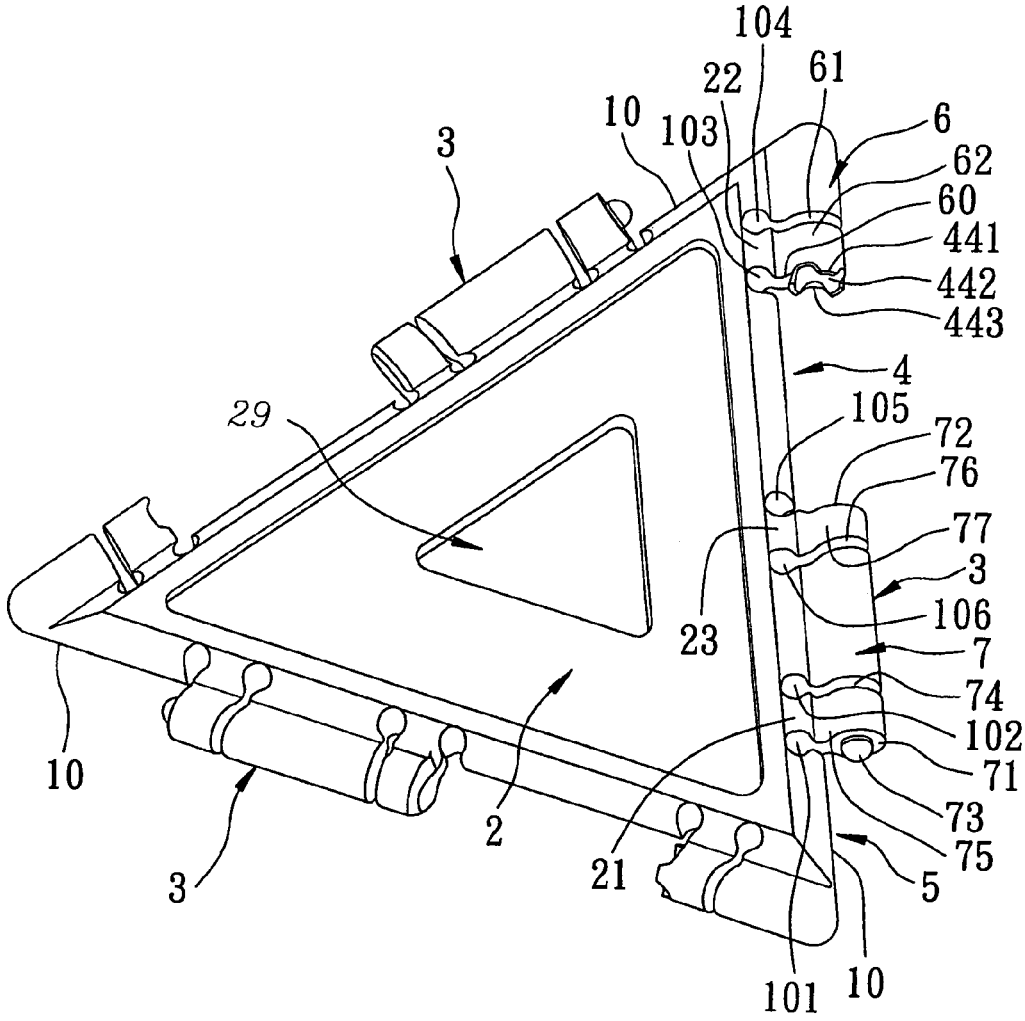
FIG. 5 is a schematic view of a triangular flat panel of the first preferred embodiment.
Figure 6:
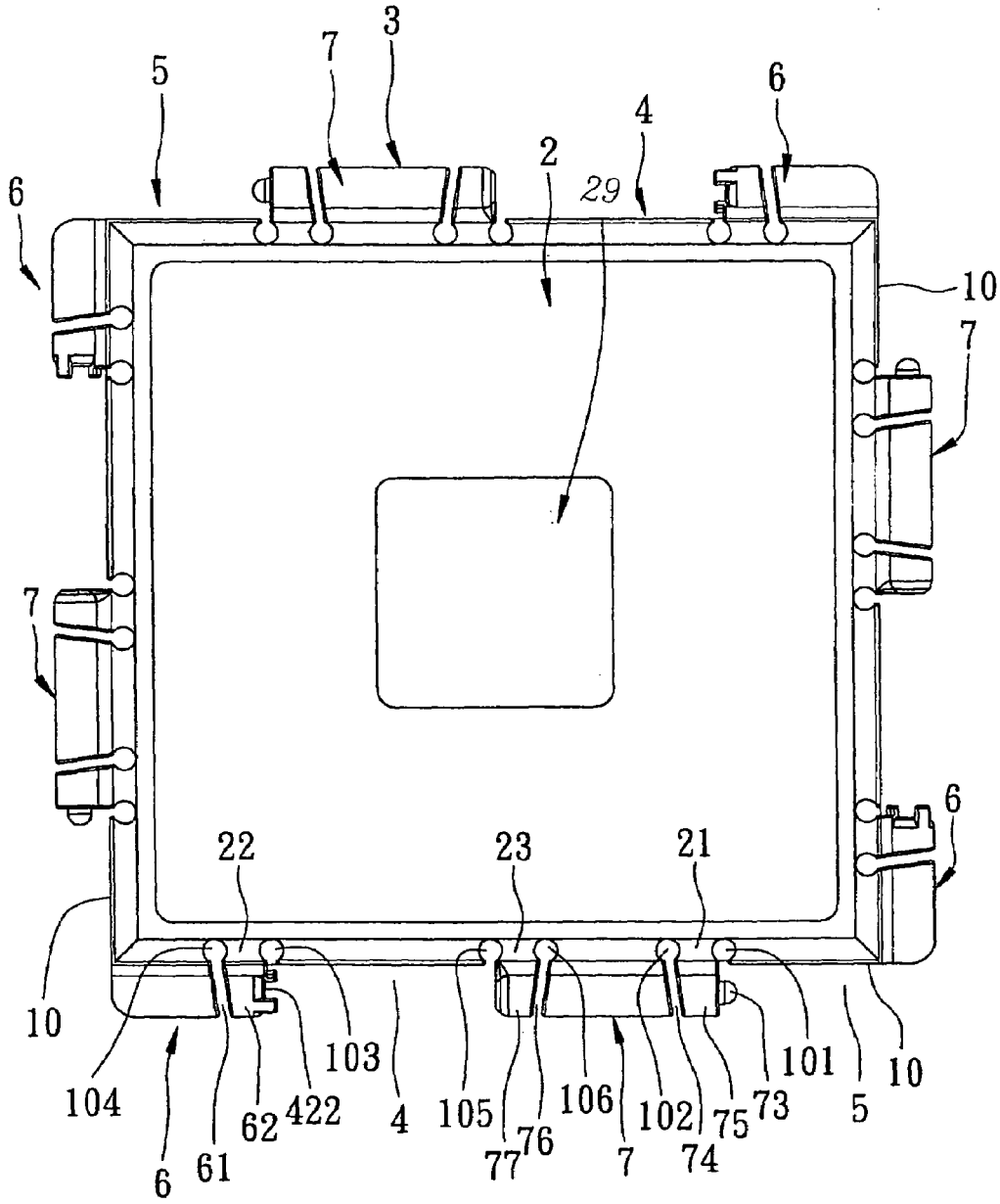
FIG. 6 is a schematic view of a rectangular flat panel of the first preferred embodiment.

FIGS. 4 to 6 illustrate the first preferred embodiment of a geometric construction system according to this invention.

The geometric construction system includes: a plurality of flat panels 2 of polygonal shape, each of the flat panels 2 having side edges 10; and a plurality of connecting units 3 provided on the side edges 10, respectively, so as to permit edgewise interengagement between adjacent ones of the flat panels 2. In this embodiment, two of the flat panels 2 are assembled together (see FIG. 4), one of which is triangular in shape (see FIG. 5), while the other is rectangular in shape (see FIG. 6). At least one of the connecting units 3 includes first and second engaging parts 7, 6. In this embodiment, all of the connecting units 3 include the first and second engaging parts 7, 6.

Figure 7:
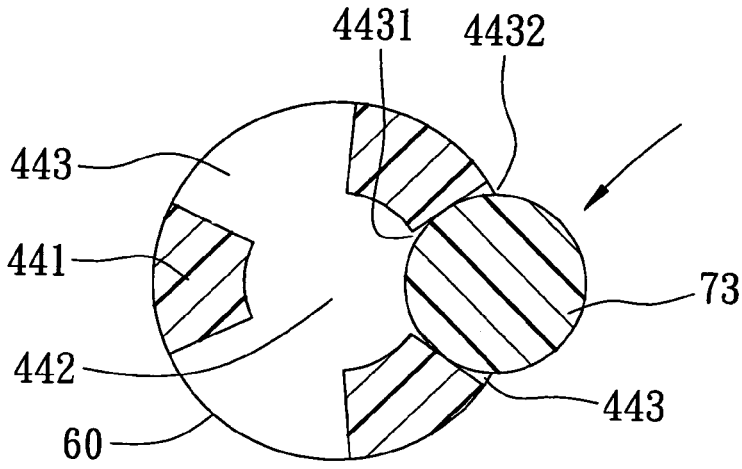
FIGS. 7 and 8 are sectional views to illustrate how a protrusion on one of the triangular and rectangular flat panels shown in FIG. 4 is inserted into a recess in the other of the triangular and rectangular flat panels.
Figure 8:
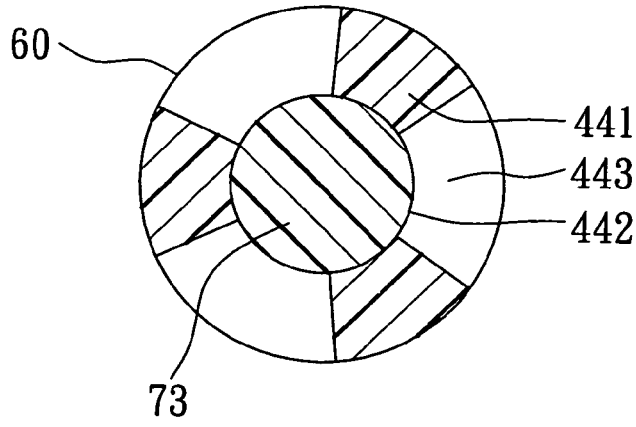

The first engaging part 7 is formed with a protrusion 73. The second engaging part 6 is formed with a recess 442 such that the protrusion 73 of the first engaging part 7 on one of the flat panels 2 is releasably engageable with the recess 442 of the second engaging part 6 on another of the flat panels 2 so as to permit edgewise interengagement between adjacent ones of the flat panels 2 and rotation of the flat panels 2 thus engaged relative to each other about an axis (X). The second engaging part 6 is further formed with resilient claws 441 (see FIG. 7) that project from and that are angularly displaced around a periphery of the recess 442. Two adjacent ones of the claws 441 of the second engaging part 6 cooperatively define a gap 443 therebetween. The claws 441 of the second engaging part 6 on one of the flat panels 2 clamp resiliently the protrusion 73 of the first engaging part 7 on another of the flat panels 2 when the protrusion 73 is moved through the gap 443 (see FIG. 7) and into the recess 442 (see FIG. 8) of the second engaging part 6 on said one of the flat panels 2.

In this embodiment, the gap 443 has inner and outer ends 4431, 4432 (see FIG. 7) that are opposite to each other in a radial direction relative to the axis (X). The gap 443 diverges from the inner end 4431 to the outer end 4432 so as to facilitate insertion of the protrusion 73 therethrough.

The first and second engaging parts 7, 6 project from a respective one of the side edges 10 in a transverse direction relative to the axis (X). The first engaging part 7 has first and second ends 71, 72 that are opposite to each other in an axial direction relative to the axis (X). The second engaging part 6 has an engaging end 60 that cooperates with the second end 72 of the first engaging part 7 to define a first inserting space 4 therebetween. The first end 71 of the first engaging part 7 cooperates with the respective one of the side edges 10 to define a second inserting space 5 that is disposed opposite to the first inserting space 4. The protrusion 73 projects from the first end 71 of the first engaging part 7. The recess 442 is formed in the engaging end 60 of the second engaging part 6. The claws 441 project from the engaging end 60 of the second engaging part 6 into the first inserting space 4.

The first engaging part 7 is formed with a first slit 74 that cuts the first engaging part 7 into a first end portion 75 which is resilient and which defines the first end 71 of the first engaging part 7. The first engaging part 7 is further formed with a second slit 76 that cuts the first engaging part 7 into a second end portion 77 which is opposite to the first end portion 75 of the first engaging part 7, which is resilient, and which defines the second end 72 of the first engaging part 7. The second end portion 77 of the first engaging part 7 on one of the flat panels 2 abuts resiliently against the second end portion 77 of the first engaging part 7 on another of the flat panels 2 when the first engaging part 7 on said one of the flat panels 2 is inserted into the first inserting space 4 on the other of the flat panels 2 and the protrusion 73 of the first engaging part 7 on said one of the flat panels 2 is received in the recess 442 of the second engaging part 6 on the other of the flat panels 2, and when the second engaging part 6 on said one of the flat panels 2 is inserted into the second inserting space 5 and the recess 442 of the second engaging part 6 on said one of the flat panels 2 receives the protrusion 73 of the first engaging part 7 on the other of the flat panels 2.

The second engaging part 6 is formed with a slit 61 that cuts the second engaging part 6 into a resilient end portion 62 which defines the engaging end 60 of the second engaging part 6. Formation of the first and second end portions 75, 77 of the first engaging part 7 and the resilient end portion 62 of the second engaging part 6 facilitates insertion of the first engaging part 7 on one of the flat panels 2 into the first inserting space 4 of another of the flat panels 2, and insertion of the second engaging part 6 on said one of the flat panels 2 into the second inserting space 5 on another of the flat panels 2, and provides adequate resilient forces for abutment between the first engaging part 7 on one of the flat panels 2 and the second engaging part 6 on another of the flat panels 2 and between the second engaging part 6 on said one of the flat panels 2 and the first engaging part 7 on another of the flat panels 2, thereby securing the connection between the flat panels 2 thus engaged.

Each of the side edges 10 of each of the flat panels 2 is formed with a first groove 101 that is disposed adjacent to the first end 71 of the first engaging part 7, a second groove 102 that is enlarged in size from the first slit 74 in the first engaging part 7, a third groove 103 that is disposed adjacent to the engaging end 60 of the second engaging part 6, and a fourth groove 104 that is enlarged in size from the slit 61 in the second engaging part 6. The first and second grooves 101, 102 cooperatively configure the respective one of the side edges 10 with a first neck portion 21 that is reduced in cross-section from the first end portion 75 of the first engaging part 7. The third and fourth grooves 103, 104 cooperatively configure the respective one of the side edges 10 with a second neck portion 22 that is reduced in cross-section from the resilient end portion 62 of the second engaging part 6.

Each of the side edges 10 of each of the flat panels 2 is further formed with a fifth groove 105 that is disposed adjacent to the second end 72 of the first engaging part 7, and a sixth groove 106 that is enlarged in size from the second slit 76 in the first engaging part 7. The fifth and sixth grooves 105, 106 cooperatively configure the respective one of the side edges 10 with a third neck portion 23 that is reduced in cross-section from the second end portion 77 of the first engaging part 7. Formation of the first, second and third neck portions 21, 22, 23 enhances the flexibility of the first and second end portions 75, 77 of the first engaging part 7 and the resilient end portion 62 of the second engaging part 6.

Each flat panel 2 is formed with at least one hole 29 with a desired geometric shape which can be used for drawing purposes.

Figure 9:
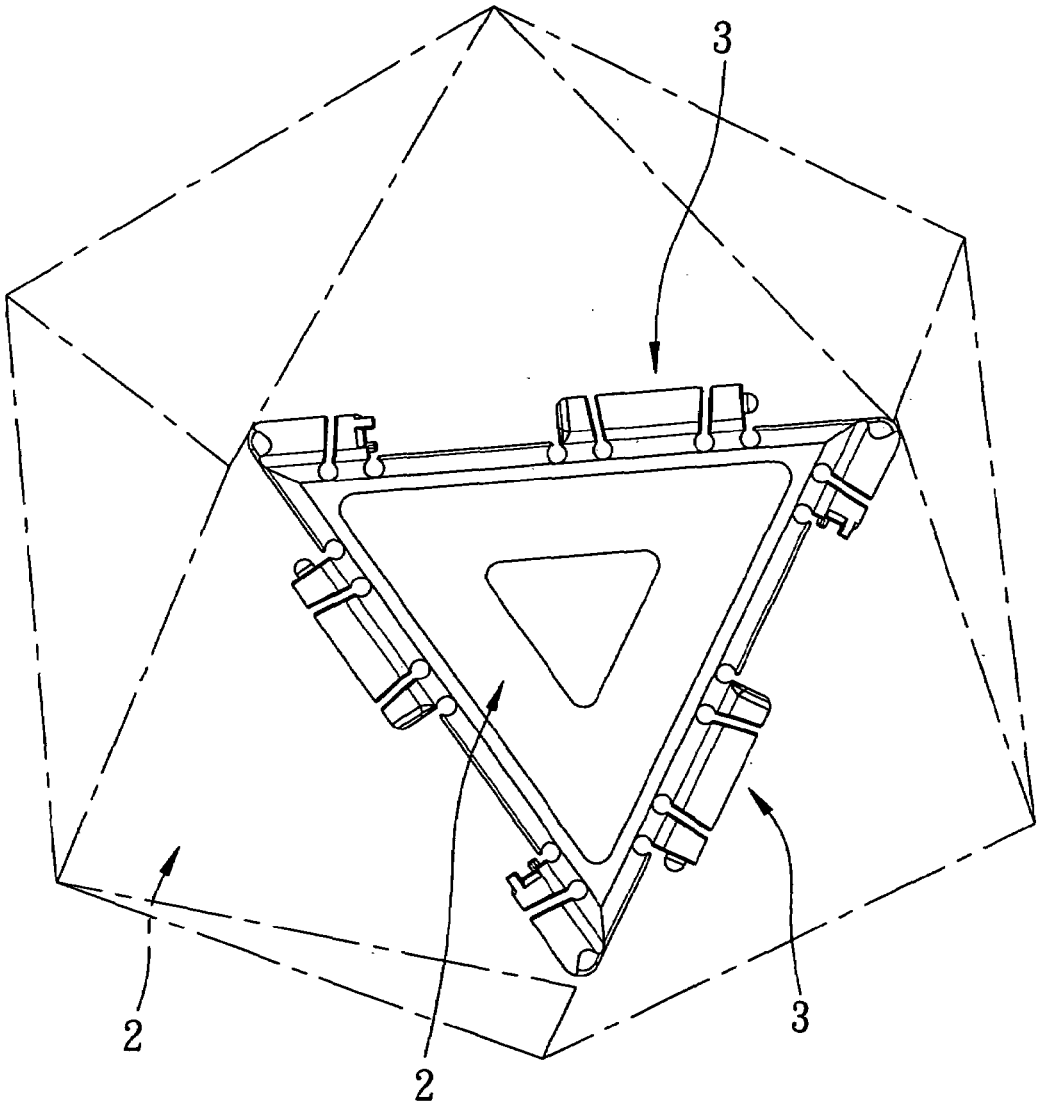
FIGS. 9 and 10 are schematic views to illustrate how the triangular flat panels of the first preferred embodiment can be constructed into different polygonal bodies.
Figure 10:
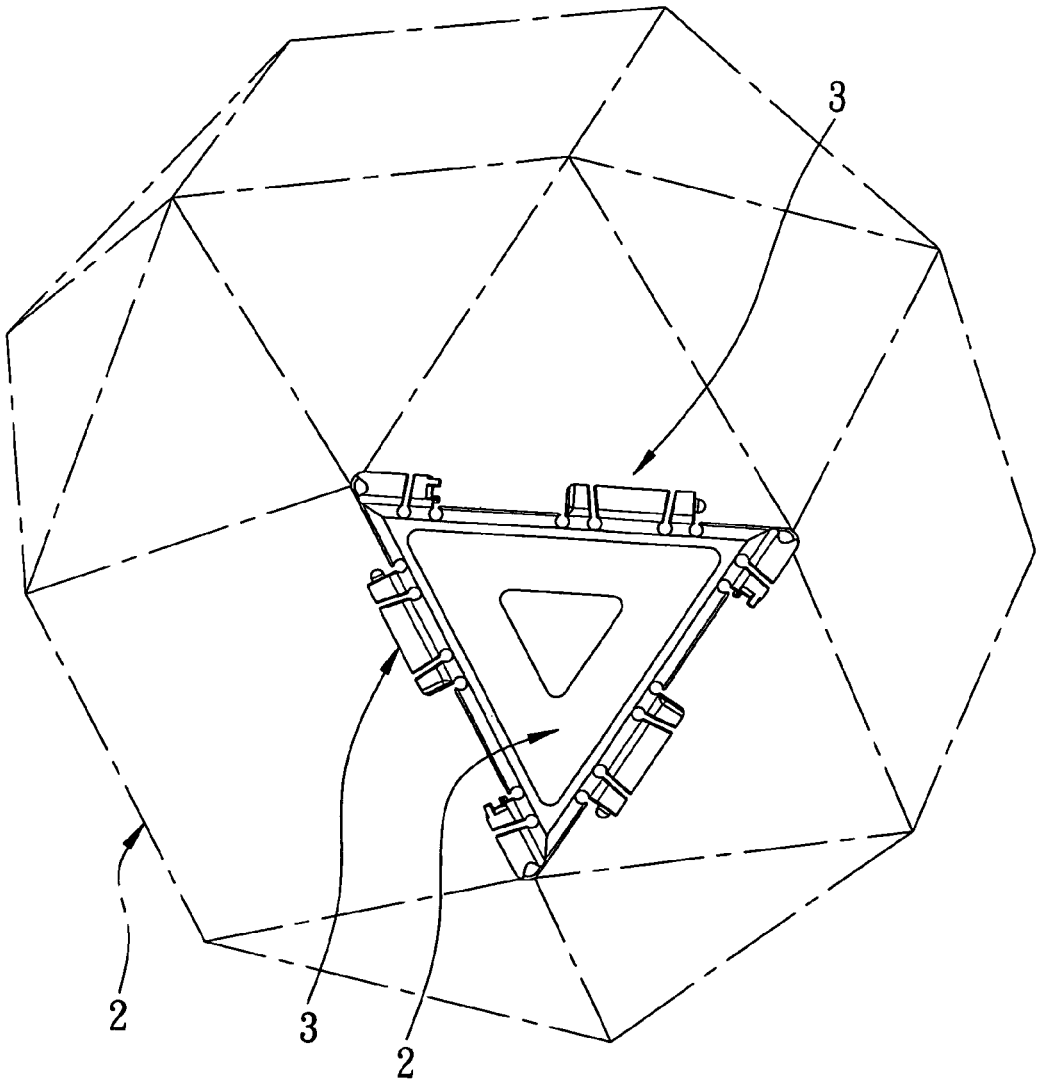

FIGS. 9 and 10 illustrate how the triangular flat panels 2 of the first preferred embodiment can be constructed into different polygonal bodies. The flat panels 2 can be made from a transparent material so as to enhance the appearances of the polygonal bodies.

Figure 11:
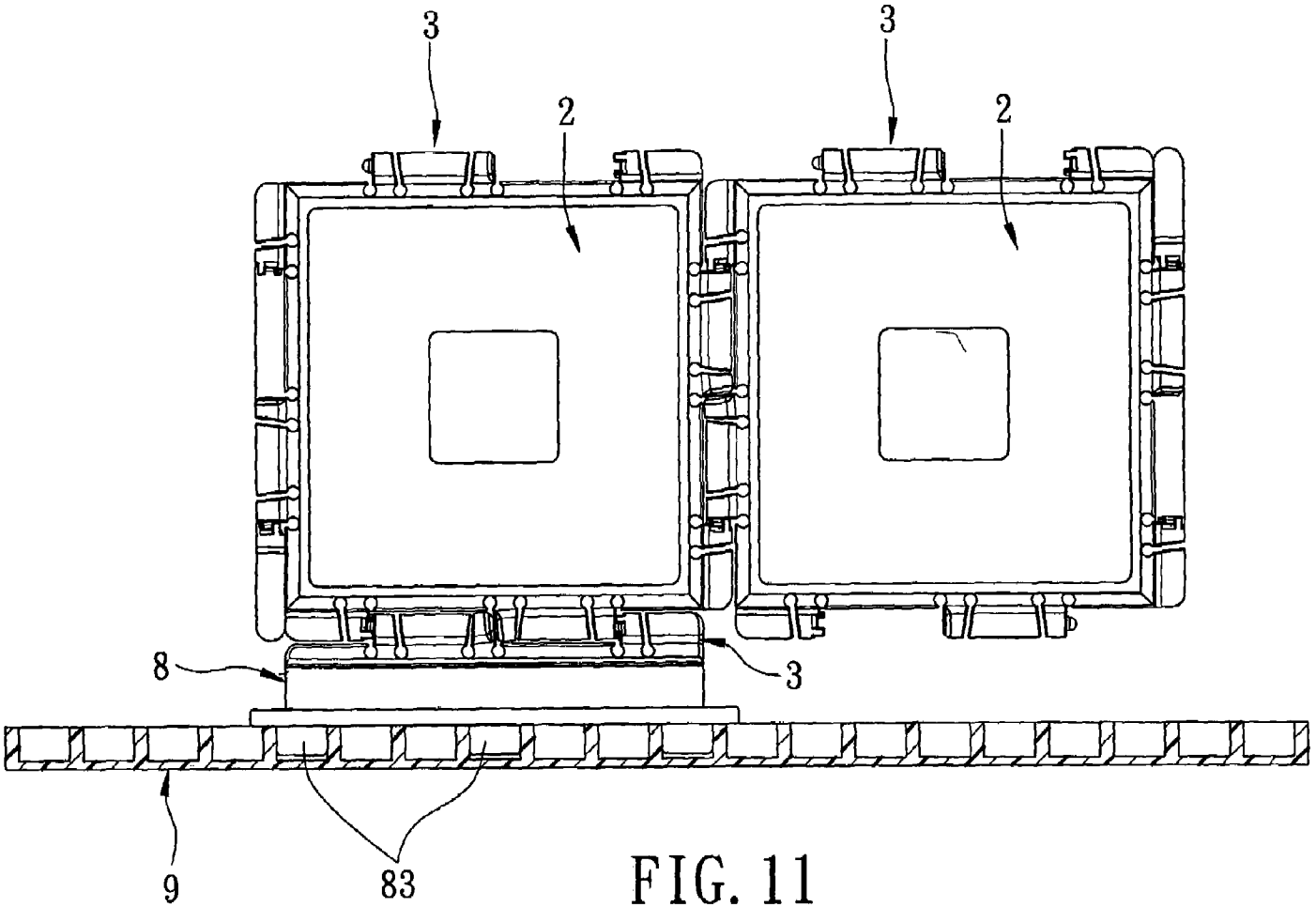
FIG. 11 is a schematic sectional view of the second preferred embodiment of the geometric construction system according to this invention.
Figure 12:
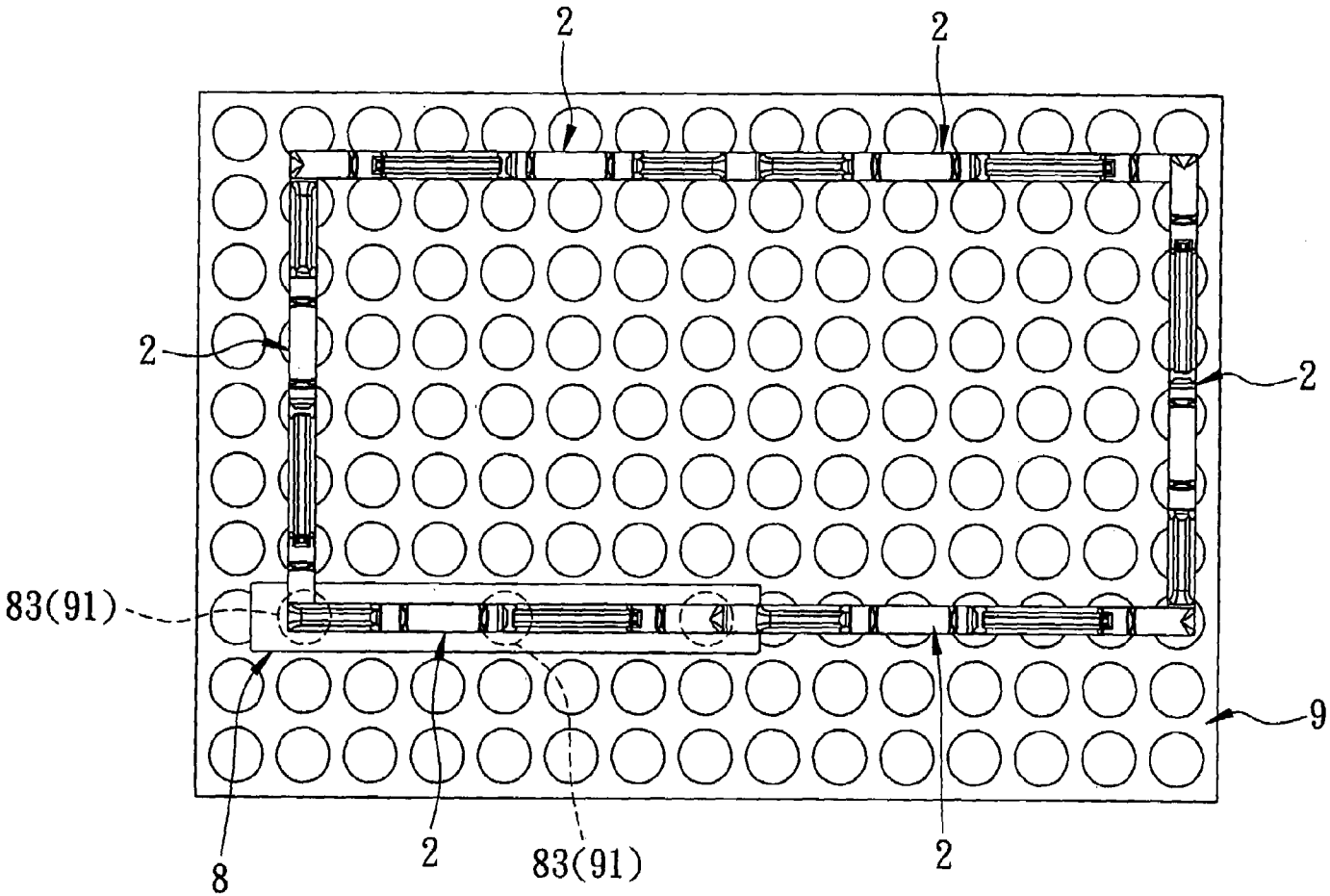
FIG. 12 is aschematic top view of the second preferred embodiment.
Figure 13:
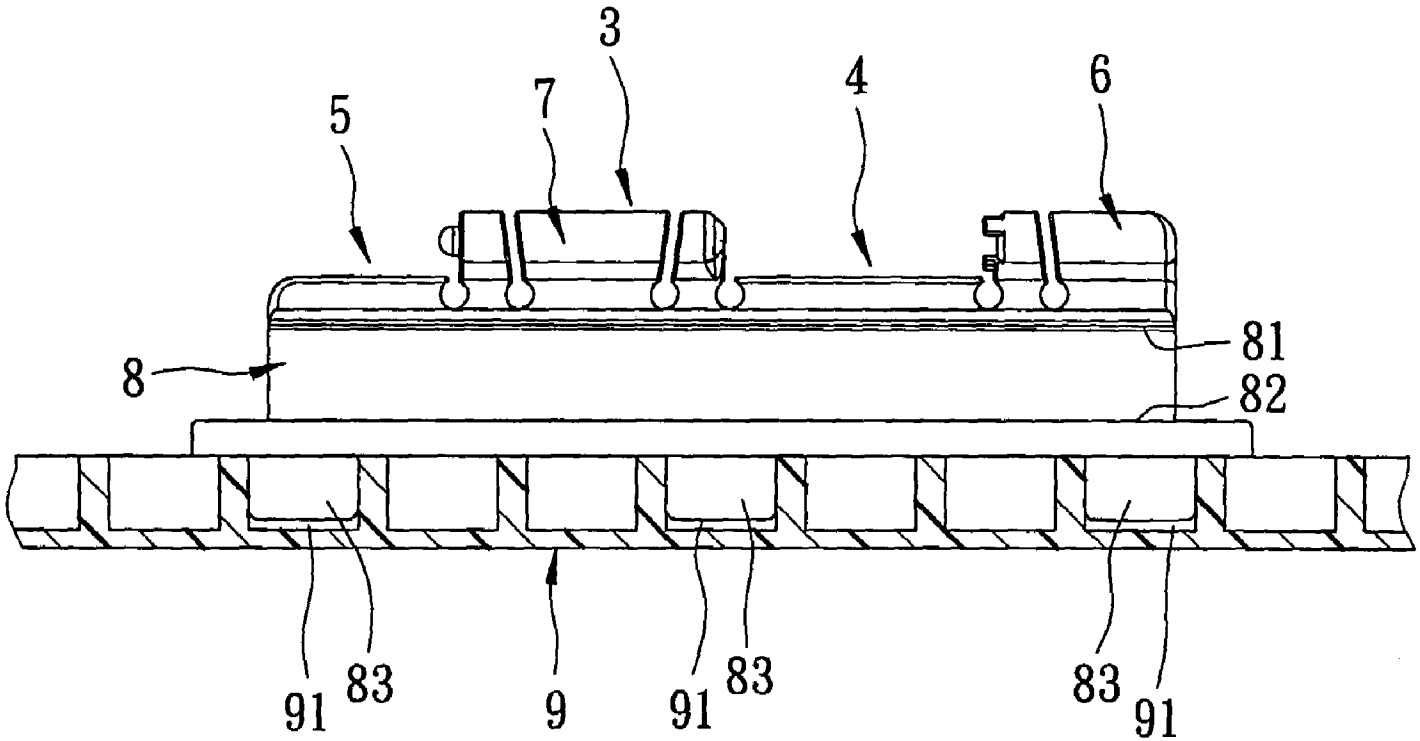
FIG. 13 is a fragmentary sectional view to illustrate how a connecting strip engages a base plate of the second preferred embodiment.

FIGS. 11 to 13 illustrate the second preferred embodiment of the geometric construction system according to this invention.

In addition to the flat panels 2 and the connecting units 3, the geometric construction system of this embodiment further includes a plurality of connecting strips 8 and a base plate 9. Each of the connecting strips 8 has opposite first and second sides 81, 82. The first side 81 of each of the connecting strips 8 is formed with the first and second engaging parts 7, 6 of the connecting unit 3 so as to permit coupling of each of the connecting strips 8 to a selected one of the flat panels 2 (see FIG. 11).

The base plate 9 is formed with an array of retaining grooves 91. The second side 82 of each of the connecting strips 8 is formed with a row of tongues 83 that are engageable with a line of selected ones of the retaining grooves 91 in the base plate 9.

With the inclusion of the connecting units 3 in the geometric construction system of this invention, firm connection among the flat panels 2 can be ensured. Moreover, formation of the first and second end portions 75, 77 of the first engaging part 7, the resilient end portion 62 of the second engaging part 6, and the first, second and third neck portions 21, 22, 23 of each of the side edges 10 of each of the flat panels 2 not only facilitates assembling operation of the flat panels 2 but also provide suitable resilient forces in retaining the connections among the flat panels 2.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

What is claimed is:

1. A geometric construction system comprising:

a plurality of flat panels of polygonal shape, each of said flat panels having side edges; and a plurality of connecting units provided on said side edges, respectively, so as to permit edgewise interengagement between adjacent ones of said flat panels;

wherein at least one of said connecting units includes first and second engaging parts, said first engaging part being formed with a protrusion, said second engaging part being formed with a recess such that said protrusion of said first engaging part on one of said flat panels is releasably engageable with said recess of said second engaging part on another of said flat panels so as to permit edgewise interengagement between adjacent ones of said flat panels and rotation of said flat panels thus engaged relative to each other about an axis; and wherein said second engaging part is further formed with resilient claws that project from and that are angularly displaced around a periphery of said recess, two adjacent ones of said claws of said second engaging part cooperatively defining a gap therebetween, said claws of said second engaging part on one of said flat panels clamping resiliently said protrusion of said first engaging part on another of said flat panels when said protrusion is moved through said gap and into said recess of said second engaging part on said one of said flat panels.

2. The geometric construction system of claim 1, wherein said gap has inner and outer ends that are opposite to each other in a radial direction relative to said axis, said gap diverging from said inner end to said outer end.

3. The geometric construction system of claim 2, wherein said first and second engaging parts project from a respective one of said side edges in a transverse direction relative to said axis, said first engaging part having first and second ends that are opposite to each other in an axial direction relative to said axis, said second engaging part having an engaging end that cooperates with said second end of said first engaging part to define an inserting space therebetween, said protrusion projecting from said first end of said first engaging part, said recess being formed in said engaging end of said second engaging part, said claws projecting from said engaging end of said second engaging part into said inserting space.

4. The geometric construction system of claim 3, wherein said first engaging part is formed with a first slit that cuts said first engaging part into a first end portion which is resilient and which defines said first end of said first engaging part.

5. The geometric construction system of claim 4, wherein said first engaging part is further formed with a second slit that cuts said first engaging part into a second end portion which is opposite to said first end portion of said first engaging part, which is resilient, and which defines said second end of said first engaging part, said second end portion of said first engaging part on one of said flat panels abutting resiliently against said second end portion of said first engaging part on another of said flat panels when said protrusion of said first engaging part on said one of said flat panels is received in said recess of said second engaging part on another of said flat panels.

6. The geometric construction system of claim 5, wherein said second engaging part is formed with a slit that cuts said second engaging part into a resilient end portion which defines said engaging end of said second engaging part.

7. The geometric construction system of claim 6, wherein each of said side edges of each of said flat panels is formed with a first groove that is disposed adjacent to said first end of said first engaging part, a second groove that is enlarged in size from said first slit in said first engaging part, a third groove that is disposed adjacent to said engaging end of said second engaging part, and a fourth groove that is enlarged in size from said slit in said second engaging part, said first and second grooves cooperatively configuring the respective one of said side edges with a first neck portion that is reduced in cross-section from said first end portion of said first engaging part, said third and fourth grooves cooperatively configuring the respective one of said side edges with a second neck portion that is reduced in cross-section from said resilient end portion of said second engaging part.

8. The geometric construction system of claim 7, wherein each of said side edges of each of said flat panels is further formed with a fifth groove that is disposed adjacent to said second end of said first engaging part, and a sixth groove that is enlarged in size from said second slit in said first engaging part, said fifth and sixth grooves cooperatively configuring the respective one of said side edges with a third neck portion that is reduced in cross-section from said second end portion of said first engaging part.

9. The geometric construction system of claim 1, further comprising a plurality of connecting strips, each of which has opposite first and second sides, said first side of each of said connecting strips being formed with said first and second engaging parts so as to permit coupling of each of said connecting strips to a selected one of said flat panels.

10. The geometric construction system of claim 9, further comprising a base plate that is formed with an array of retaining grooves, said second side of each of said connecting strips being formed with a row of tongues that are engageable with a line of selected ones of said retaining grooves.

* * * * *